United States Patent [19]

Youngblood et al.

[11] 4,180,287

[45] Dec. 25, 1979

[54] CELL LOCKING SYSTEM

[75] Inventors: David H. Youngblood; Quentin H. Young, both of San Antonio, Tex.

[73] Assignee: Southern Steel Company, San Antonio, Tex.

[21] Appl. No.: 894,129

[22] Filed: Apr. 6, 1978

[51] Int. Cl.[2] ..... E05C 1/08

[52] U.S. Cl. ..... 292/144

[58] Field of Search ..... 292/144, 201, DIG. 18, 292/DIG. 25, 33, 40, 143, 173

[56] References Cited

U.S. PATENT DOCUMENTS

| | | | |
|---|---|---|---|
| 775,186 | 11/1904 | Lovelace | 292/173 X |
| 2,798,751 | 7/1957 | Walden | 292/144 |
| 3,605,459 | 9/1971 | Van Dalen | 292/335 X |
| 3,890,608 | 6/1975 | Peterson | 292/DIG. 25 X |
| 3,897,093 | 7/1975 | Wiczer et al. | 292/144 |

*Primary Examiner*—Richard E. Moore

*Attorney, Agent, or Firm*—Mason, Fenwick & Lawrence

[57] ABSTRACT

A dead bolt and lock bolt for a cell door have the dead bolt controlled electrically from a remote control station. The lock bolt is controlled electrically from the remote station or the door location itself. A main control lever at the control station is movable to a deadlock position for mechanically deadlocking the lock bolt in its locking position and to a release position for unlocking both the dead bolt and the lock bolt. Protective circuit means prevents the dead bolt from being moved to its extended position when the door is open and a protective deadlock latch locks the dead bolt in either its retracted position or its extended position. When the main control lever is moved to an operate position, the guard or inmate can unlock or lock the door by use of a key if the dead bolt is in its retracted position.

62 Claims, 15 Drawing Figures

Fig-1
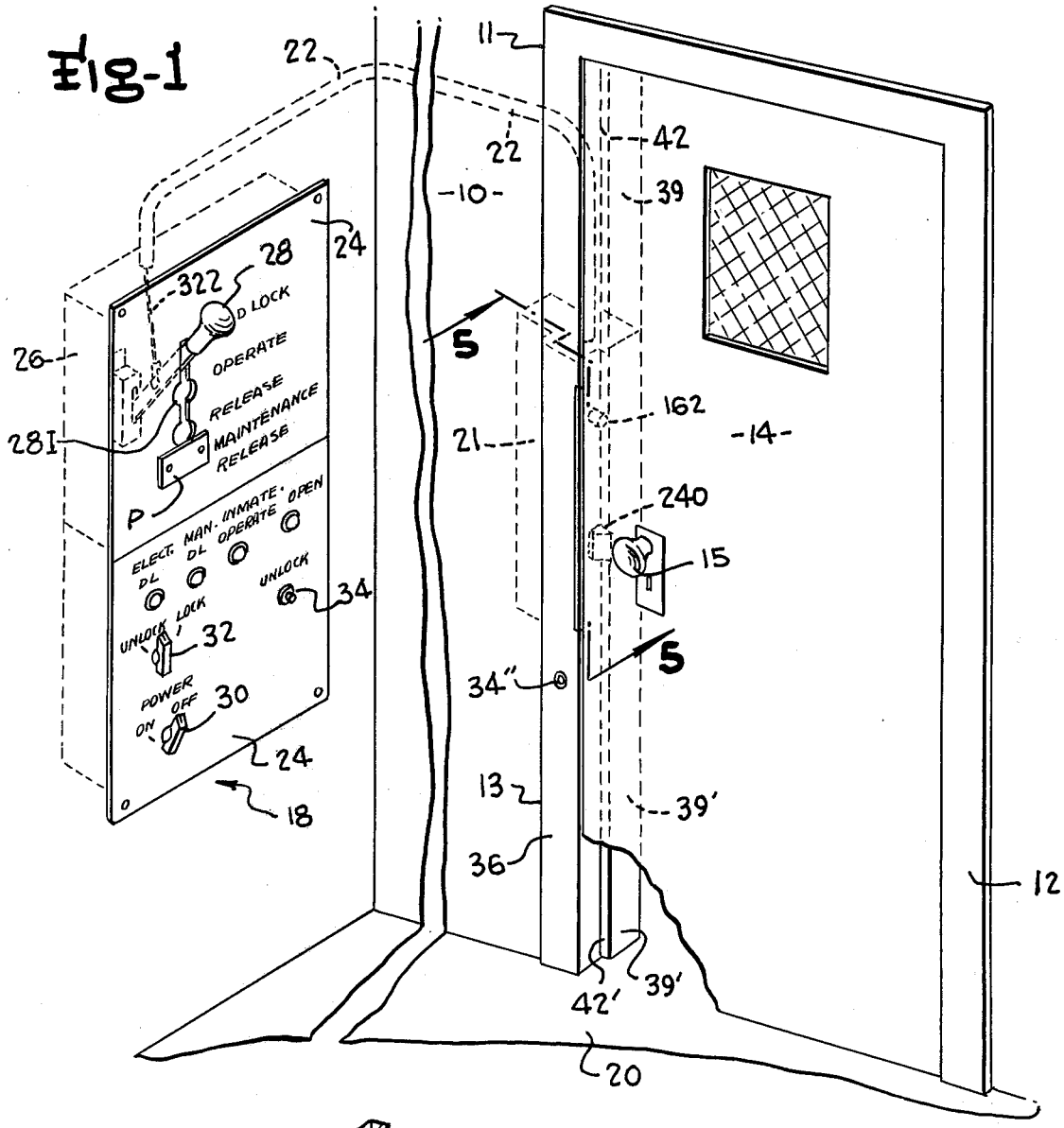
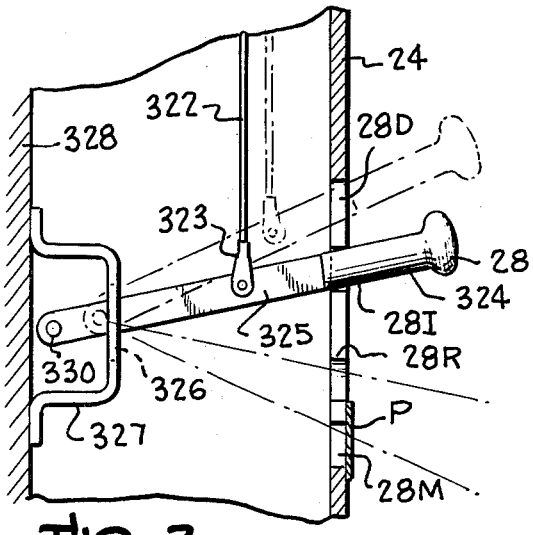
Fig-3
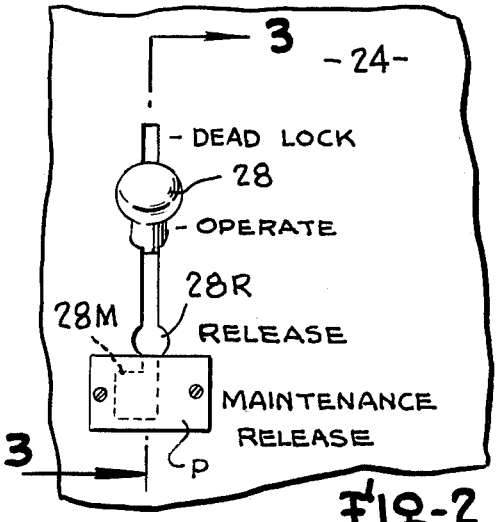
Fig-2

21
44
40
20
23
322
139
140
139
142
42"
138
136
43
-49-
42
39
39"
40"
88
86
82
38
70
41
70
37
40
45
36
70
51
-46-
70
212
321
38"
160
162
170
196
184
178
176
206
204
314
339
338
337
-278-
94
242
260
248
274
258
-96-
240
80
256
312
110
317
320
106
114
116
108
118
122
104
84
38"
36"
75
73
50
74
72
47
45
13
76
39'
38'
42'

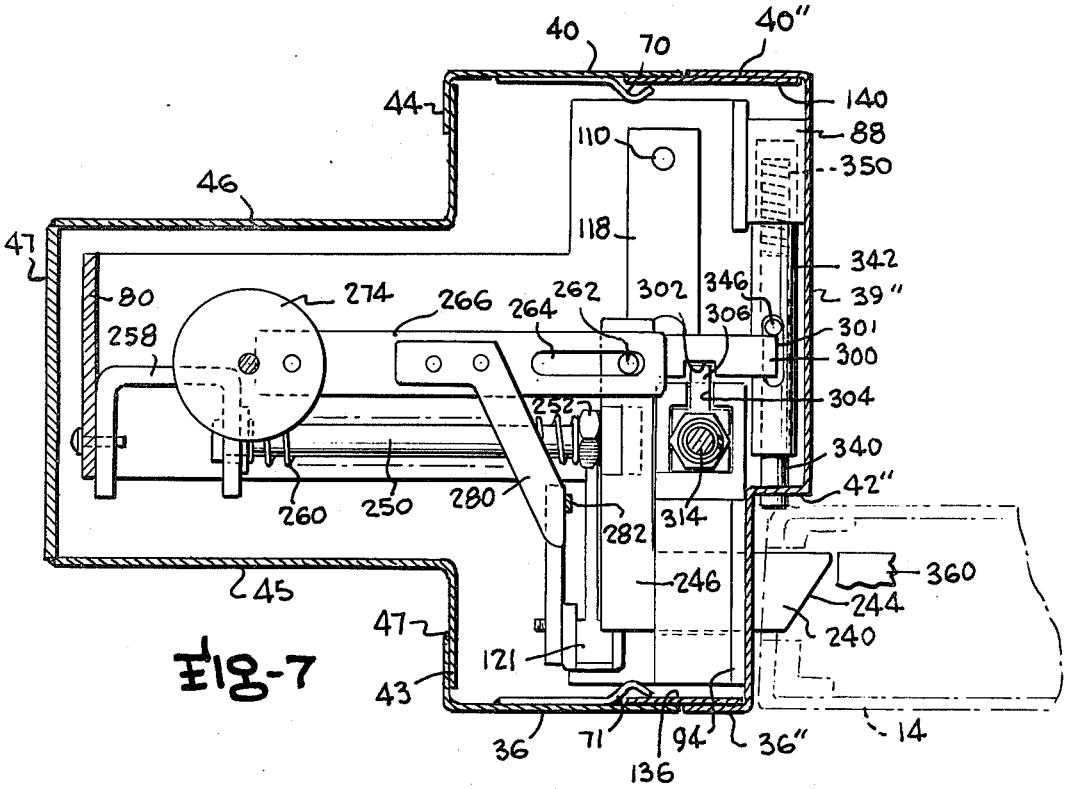
Fig-7
Fig-9
Fig-8
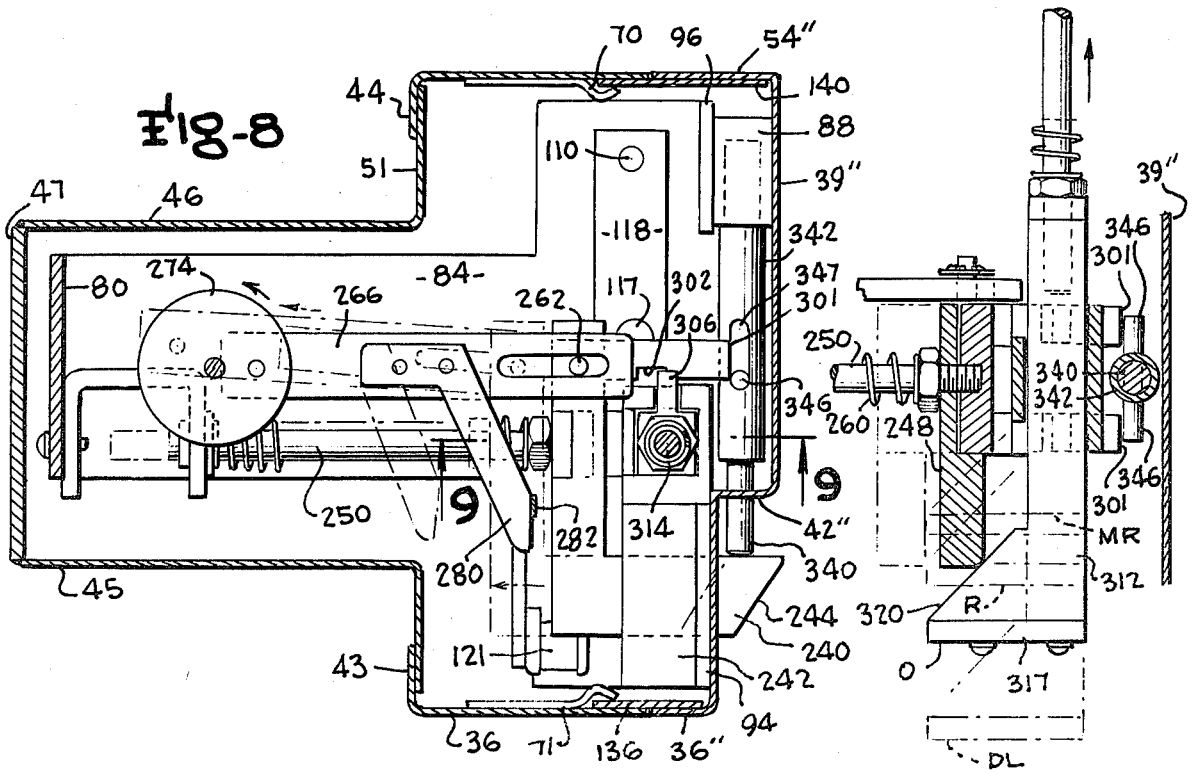

CELL LOCKING SYSTEM

This invention is in the field of jail and/or prison equipment and is more specifically directed to a cell door locking and unlocking system that is both electrically and manually operated. More specifically, the subject invention is directed to a cell door locking and unlocking system which can normally be controlled electrically from a remote location such as a guard station but which is also capable of manual operation from the same remote location for unlocking the door in the event of power failure or an emergency situation such as a fire, regardless of whether the door was originally locked by electric or manual means; another feature of the inventive system permits opening, closing and locking of the cell door by a guard, using a key at the door. Still another feature of the inveitive system permits opening, closing, and locking of a cell door by the inmate occupant under the permissive control of the guard during certain times so that the inmate can come and go from the cell but can lock the door for privacy while in the cell and to keep others from entering during his absences. A unique security feature is the ability of the guard in the control room to cancel this function at the door at any time by moving the manual control lever to deadlock position.

One problem with prior known cell door locking systems employing extendable bolt members mounted in the door frame is that the bolt members are sometimes extended while the door is open; consequently, the inmates can slam the door against the bolt to damage the bolt and/or its control mechanism. Another problem with prior known locking systems employing plural solenoid actuated bolt members is that some such systems require that one or the other of the solenoids be electrically energized at all times. In U.S. Pat. No. 3,792,888 a solenoid actuated bolt system employs relatively expensive pivotal connections between the bolt member and a bell crank actuated by one or the other of a pair of solenoids for driving the bolt to either an extended or a retracted position. There is no means provided for locking or retaining the bolt in its retracted position and it is sometimes possible for the inmate to pull the bolt outwardly when the door is open to consequently effect damage to the bolt member. The present invention solves this problem in a unique manner.

Therefore, it is the primary object of this invention to provide a new and improved door locking system under the master control of a central control station but permissively permitting operation of the door at the door location and recapturing said permissive functions from the central control panel regardless of conditions at the door.

Achievement of the foregoing object is enabled by the preferred embodiment of the invention in which a door frame removably supports a modular locking mechanism including a dead bolt and a lock bolt. The dead bolt is electrically operated by first and second solenoids to be either positioned in an extended locking position in the door or in a retracted unlocking position. The lock bolt is normally urged to an extended position by a spring means but is capable of being moved to a retracted unlocking position by an electric motor. The electric motor for moving the lock bolt to its retracted position to permit the door to open is capable of being actuated by a guard at a central control station when the dead electrically operated bolt is in its retracted position. Additionally, the lock bolt drive motor is also capable of being actuated to retract the lock bolt by a keyed switch and/or push button means provided both inside and outside the cell on which the locking system is provided so as to permit the inmate to leave the cell, lock the door and then unlock the door upon return, or permit a guard to operate the key switch on the outside of the cell while inmate push-button is deactivated. Additionally, the lock bolt can optionally be moved to its retracted position by a pusher bolt mounted inside the door and operable by key controlled door handle or key lock or the like. This permissive function can be cancelled at any time by moving the control lever to the deadlock position at the guard central control station.

The central control station has a main control lever which is positionable in three operating positions consisting of a deadlock position in which the lock bolt is locked in its extended position if the door is closed at the time the lever is moved to the deadlock position or following closure of the door at a time subsequent to movement of the lever to the deadlock position. In the last instance, closure of the door results in retraction of the lock bolt to permit the door to close followed by return of the lock bolt to its locking position in which it is automatically deadlocked. The dead bolt is electrically controlled for movement to its locking position solely from the control station. When both the dead bolt and the lock bolt are in their extended locking positions the main control lever can be moved to a release position to mechanically move both of the bolt members to the retracted position in the event of an emergency or power failure. The door can be released and allowed to snap-lock on closing or released and prevented from either electrically re-locking or manually re-locking.

Another feature of the preferred embodiment is the provision of control means for preventing movement of the the dead bolt to its extended position when the door is in an open condition. Consequently, damage to the dead bolt is precluded. Additionally, a unique deadlock system for the dead bolt deadlocks the dead bolt in both its extended position and is retracted position. By locking the bolt in the retracted position, there is no way in which the inmates can pry or move the bolt outwardly to possibly damage same while the door is open.

A better understanding of the manner in which the preferred embodiment of the invention achieves the foregoing objects will be enabled when the following written description is considered in conjunction with the appended drawings in which:

FIG. 1 is a perspective view of the preferred embodiment for controlling a cell door as installed in a detention facility such as a jail or prison;

FIG. 2 is an enlarged front elevation of a portion of a control panel provided at a guard operated control station remotely located from the cell door controllable from the control station.

FIG. 3 is a sectional view taken along lines 3—3 of FIG. 2;

FIG. 7 is a sectional view taken along lines 7—7 of FIG. 5 illustrating the parts in a position in which the cell door is closed and the lock bolt is in an extended door latching position;

FIG. 8 is a sectional view taken similarly to FIG. 7 but illustrating the lock bolt in an intermediate position through which it is moved from the position of FIG. 7 during movement of the bolt toward a retracted position;

FIG. 9 is a sectional view taken along lines 9—9 of FIG. 8;

Figure 4:
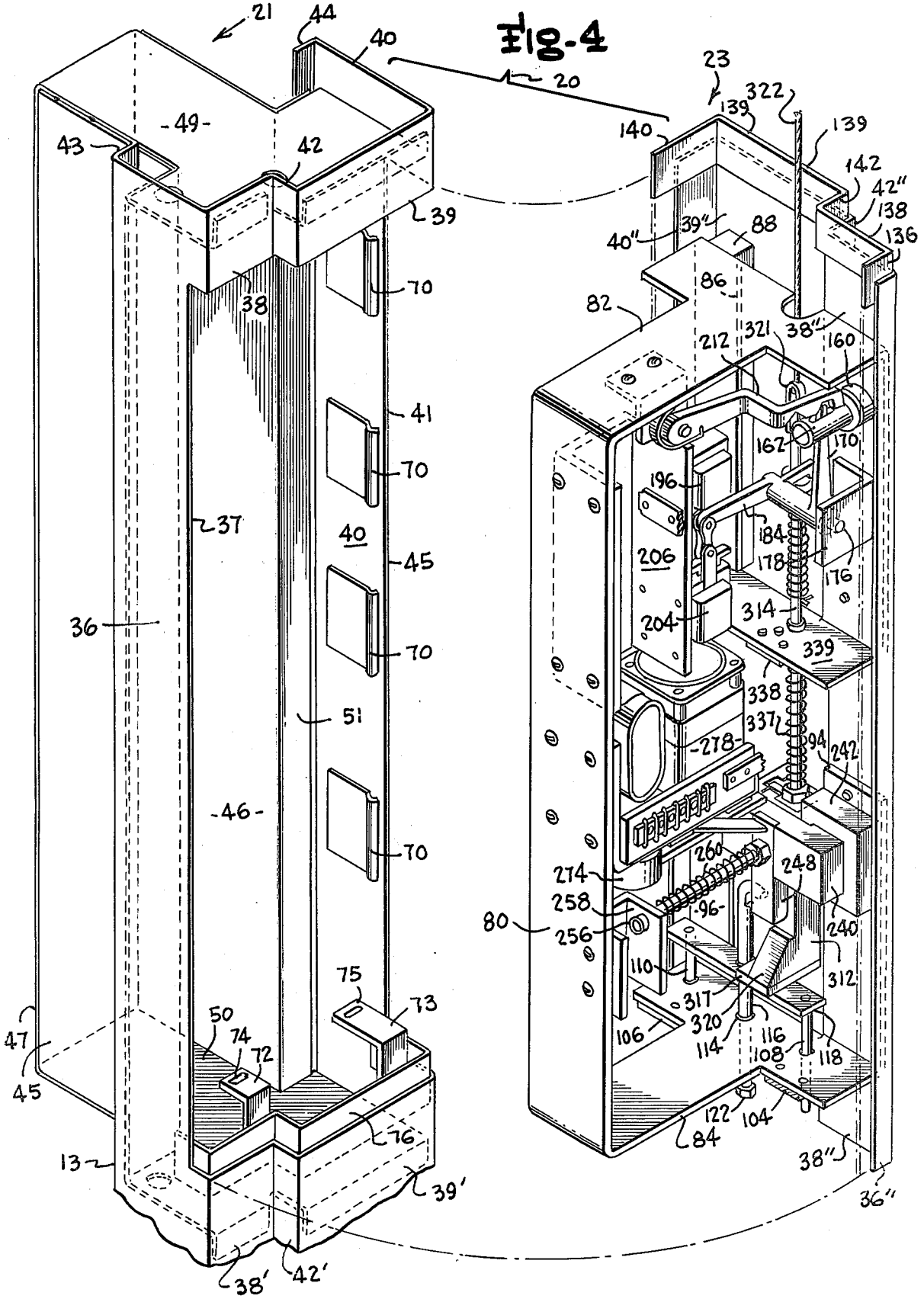
FIG. 4 is a perspective of a portion of a door frame and door locking and control means mountable therein.

Attention is initially invited to FIG. 1 of the drawings which illustrates a typical installation of the preferred embodiment in a detention facility having a wall 10 in which a steel door frame 11 has a vertical hinge support frame 12 which supports a cell door 14 and an opposite vertical frame component 13 which supports a module assembly housing 21. Housing 21 encloses latching and locking means for the door which is illustrated in a closed position with area 20 being a hall or corridor with a cell being on the other side of door 14.

A remote operator maintained control station generally designated 18 is provided at a protected secure guard station in an area not accessible to the inmates which is spaced from the door 14 and is connected to the door locking and control means by a wall embedded means including a cable chase 22 and electrical conductors. The control station 18 can even be on a different floor from door 14 if desired. The remote control station includes a control panel 24 on the front of a housing 26 in which both mechanical and electrical control members are provided. Control elements at the control housing 26 include a manually operable main control member consisting of a movable lever 28, a main power switch 30, a dead bolt actuator switch 32 and a lock bolt unlock switch button 34; the purpose of the foregoing elements will become apparent from the following detailed description.

It should be understood that the area 20 immediately outside door 14 in FIG. 1 comprises a "public" portion of the detention facility such as a hall or corridor exterior of inmate's cell which is on the other side of door 14. The guard station is not accessible to inmates in the public area and the guard has the ability to completely deadlock door 14 so that it can only be unlocked from the control station or to permit unlocking at the door location by the use of a key in a mechanical lock mounted in the door, or by key actuated switch mounted in the door frame. The system permits permissive inmate operation of the door by key or electrical switch means under the supervisory control of the guard so that the inmate can come and go from the cell while keeping the door locked both when he is in or away from the cell; however, all of the locking means can be manually released at any time by the guard at the control station in the event of an emergency.

Figure 6:
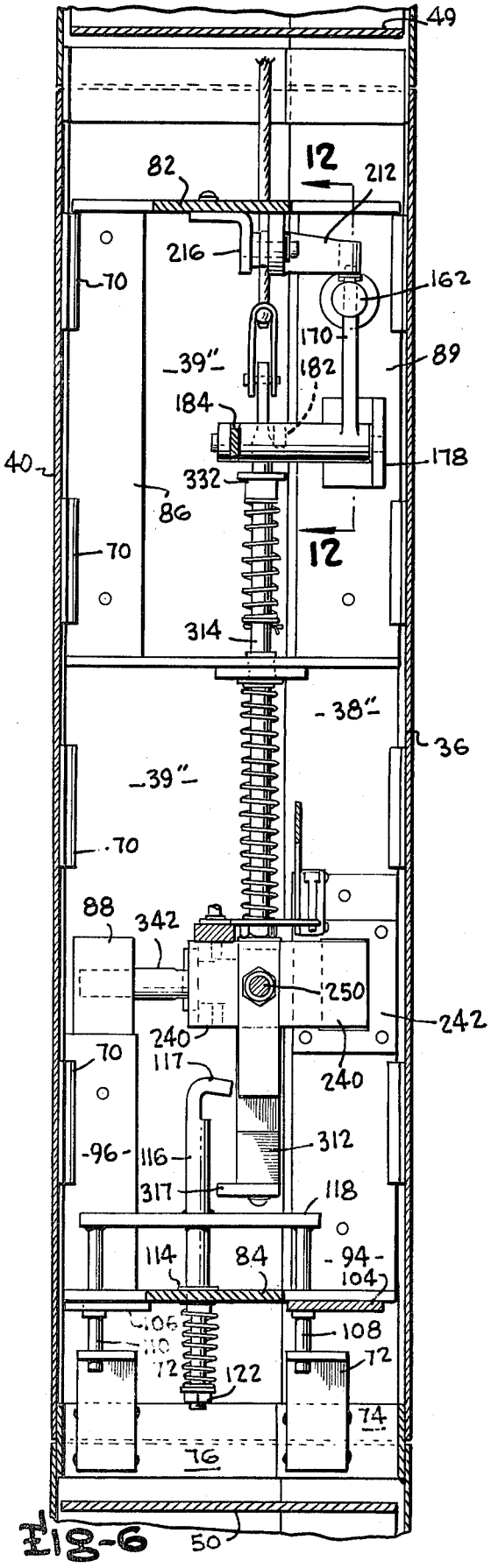
FIG. 6 is a sectional view taken along lines 6—6 of FIG. 5.
Figure 5:
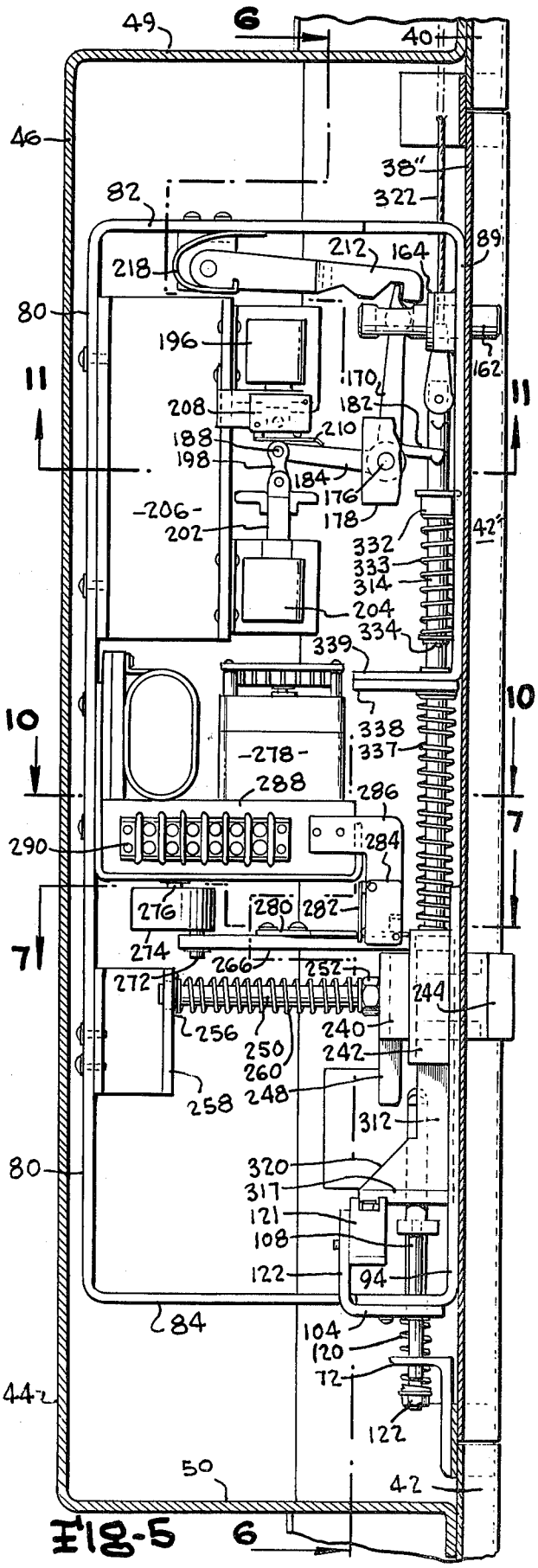
FIG. 5 is a sectional view taken along lines 5—5 of FIG. 1.
Figure 10:
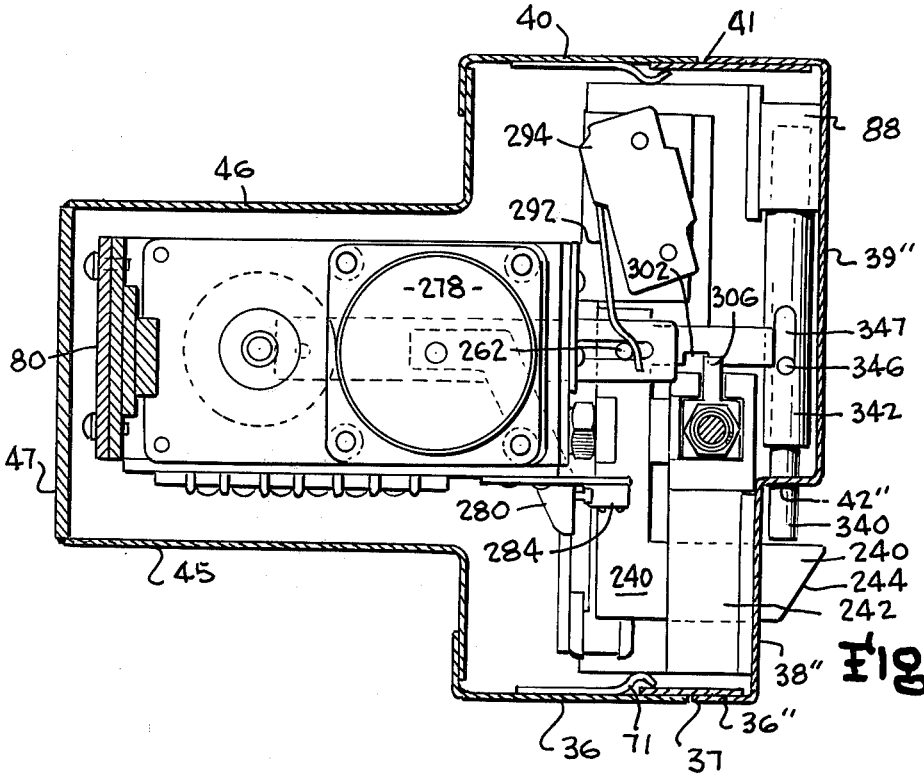
FIG. 10 is a sectional view taken along lines 10—10 of FIG. 5.

Turning now to FIGS. 4 through 6, attention is first invited to FIG. 4 which illustrates the door locking and controlling module unit 23 which is mounted centrally in the recessed module assembly housing 21 welded in the vertical door frame component 13 which includes a vertical outside facing plate 36 having a recessed edge 7. Frame 13 also includes an inside facing plate 40 which has a recessed vertical edge 41. Door facing plate means consists of an upper door facing plate 38 and a lower door facing plate 38'; similarly, inside door facing plate means comprises an upper inside door facing plate 39 and a lower inside door facing plate 39'. Plates 38 and 39 are joined by an upper jamb plate 42 while plates 38' and 39' are joined by a lower jamb plate 42'. Inwardly turned positioner flanges 43 and 44 extend from the side edges of plates 36 and 40 respectively and engage outturned flanges on front and rear vertical closure plates 45, 46 joined to a back closure plate 47. Support housing 21 also includes upper and lower closure plates 49 and 50. A plurality of mounting clips 70 are mounted on the inner face of the inside facing plate 40 and similar clips 71 are attached to the inner face of outside facing plate 36 as shown in FIG. 10. Support lugs 72 and 73 are respectively mounted on the inner faces of positioner plates 74 and 76 which in turn are respectively attached to the inner surfaces of lower door facing plates 38' and 39'. Lugs 72 and 73 respectively have lock pin receiving openings 74 and 75 which permit the removable mounting of the module 23 in the frame housing 21.

Module 23 includes a main U-shaped frame member comprising a vertical back plate 80, an upper T-shaped head plate 82 and a lower T-shaped head plate 82 spaced from the back wall plate 80 is unitarily connected to a vertical plate 86 attached to a spacer block 88 as shown in FIG. 4 with the opposite side of the upper T-shaped head plate 82 being unitarily connected to a vertical attachment plate 89. Spacer block 88 and vertical attachment plate 89 are attached to a plate component 39" of a one-piece steel face plate which includes plate components 36", 38", 42", 49" and 40", which are respectively coplanar and aligned with the plates 36, 38, 42, 39 and 40 when the components are in their assembled position. Positioner tab plates 140, 139, 142, 138 and 136 are respectively welded to the upper ends of inner surfaces of plates 40", 39", 42", 38", and 36"as shown in FIG. 4.

Figure 11:
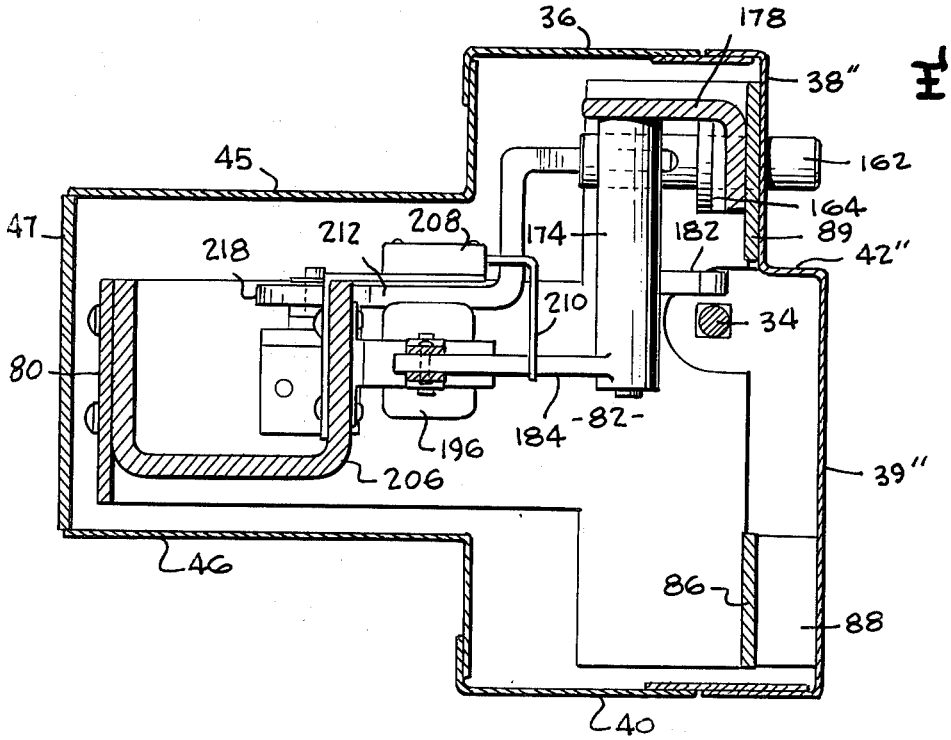
FIG. 11 is a sectional view taken along lines 11—11 of FIG. 5.

The lower T-shaped plate 84 is unitarily connected to plate 38" by a vertically extending attachment plate 94 along one side as shon in FIG. 4 and is connected to a vertical plate 96 on an opposite side which is in turn connected to a support block 98 as shown in FIG. 8. Support block 98 is affixed to the inner surface of plate component 39" as shown in FIG. 11 and support block 88 is similarly attached to the inside surface of plate 39".

Figure 14:
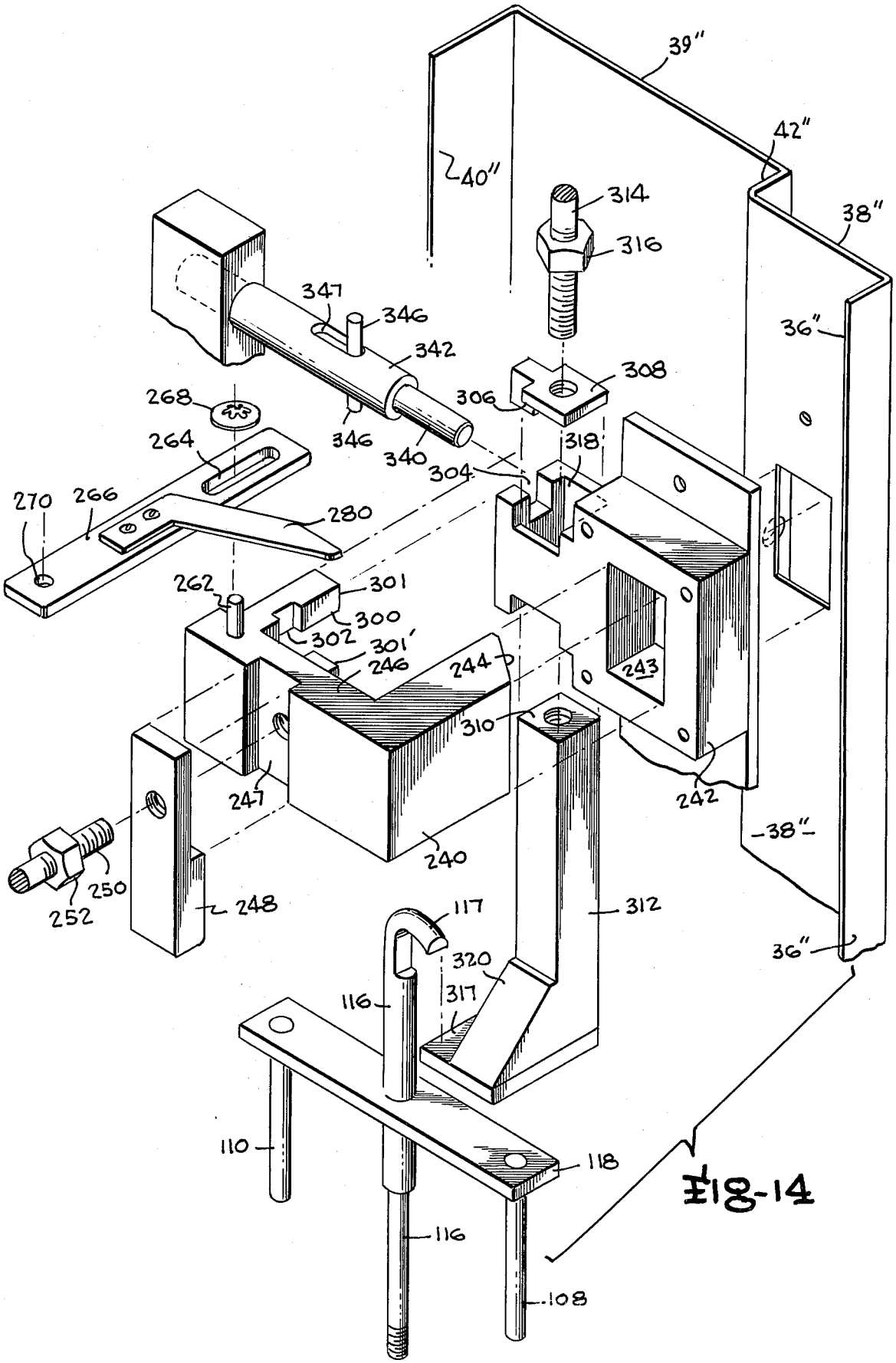
FIG. 14 is an exploded perspective view of the lock bolt and associated mounting and control means employed therewith.

A first slide bearing plate 104 is attached to the lower surface of lower T-shaped foot plate 84 and a second slide bearing plate 106 is similarly attached to the opposite side of the foot plate 84. Slide bearing plates 104 and 106 respectively include slide bearings in which first and second lock pins 108 and 110 which are aligned with lock pin receiving openings 74 and 75 are mounted for axial movement. Additionally, a slide bearing 114 is provided in the foot plate 84 with the lower end of a lifter rod 116 being positioned for axial movement in bearing 114. The upper end of the lifter rod 116 includes a hook portion 117 with elements 108, 110 and 116 all being fixedly connected by a transverse plate 118 to form a unitary movable structure as shown in FIG. 14.

A compression spring 120 encircles lifter rod 116 and extends between the lower face of plate 104 and a nut 122 on the lower end of lifter rod 116 as shown in FIG. 5 to urge the unit downwardly so that lock pins 108 and 110 are positioned in the openings 74 and 75 to hold the lower end of the module 23 in position in the frame supported housing 21.

A manual deadlock detection microswitch 121 having contacts 121A and 121B is mounted on a vertical extension 122 of the slide bearing support plate 104 as shown in FIG. 5 for a purpose that will be described hereinafter. Switch 121 is not illustrated in FIG. 4 to avoid cluttering of the figure.

Figure 12:
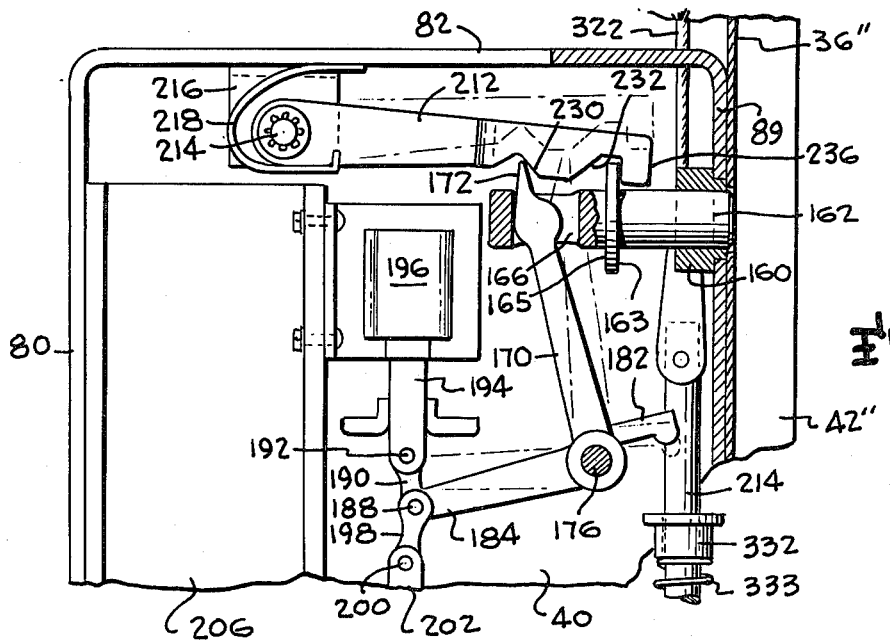
FIG. 12 is a sectional view taken along lines 12—12 of FIG. 6 illustrating the dead bolt and its associated actuator and deadlock means.

A dead bolt support fitting 160 is mounted in vertical attachment plate 89 and supports an electrically actuated dead bolt 162 of generally cylindrical configuration for axial reciprocation between a retracted or unlocking position illustrated in FIG. 12 and an extended locking position illustrated in FIG. 11. It should be understood that dead bolt 162 does not have to be of cylindrical configuration and a square or rectangular crosssection or double ribbed configuration could be employed. Additionally, the dead bolt 162 includes a radial flange having first and second abutment surfaces 163 and 165 and an elongated drive slot 166 in which a rounded drive portion 168 of an actuator arm 170 is loosely positioned; it is of some importance that rounded drive portion 168 and is capable of substantial free play in drive slot 166 and is not actually connected to the bolt 162. The upper end of the actuator arm 170 includes an upwardly extending camming finger 172 with the lower end of the arm being connected to a cylindrical bearing element 174 mounted on a pivot support shaft 176. Pivot support shaft 176 is fixedly supported on a shaft support bracket 178 attached to vertical attachment plate 89 as shown in FIG. 4. An emergency release arm 182 extends outwardly from the lower end of actuator arm 170 and a drive arm 184 extends outwardly from the lower end of actuator arm 170 and bearing 174 in an opposite direction. The outer end of drive arm 184 has a pivot opening 166 through which a pin 188 (FIG. 12) extends.

A drive link 190 is pivotally connected on one end to pivot pin 188 and is pivotally connected by pivot means 192 on its opposite end to the outer end of a plunger 194 of a locking solenoid 196 as best shown in FIG. 12. Similarly, a drive link 198 is also pivotally connected to pin 188 and has its opposite end connected to a pivot pin 200 on the outer end of a plunger 202 of an unlock solenoid 204. Solenoids 196 and 204 are mounted on a bracket plate 206 fixedly connected to the back plate 80 which also provides support for a deadlock indication microswitch 208 having an actuator 210 positioned to be engaged by drive cam 184 when the arm is in the dead bolt extend position illustrated in FIG. 5 in response to actuation of the locking solenoid 196.

Figure 13:
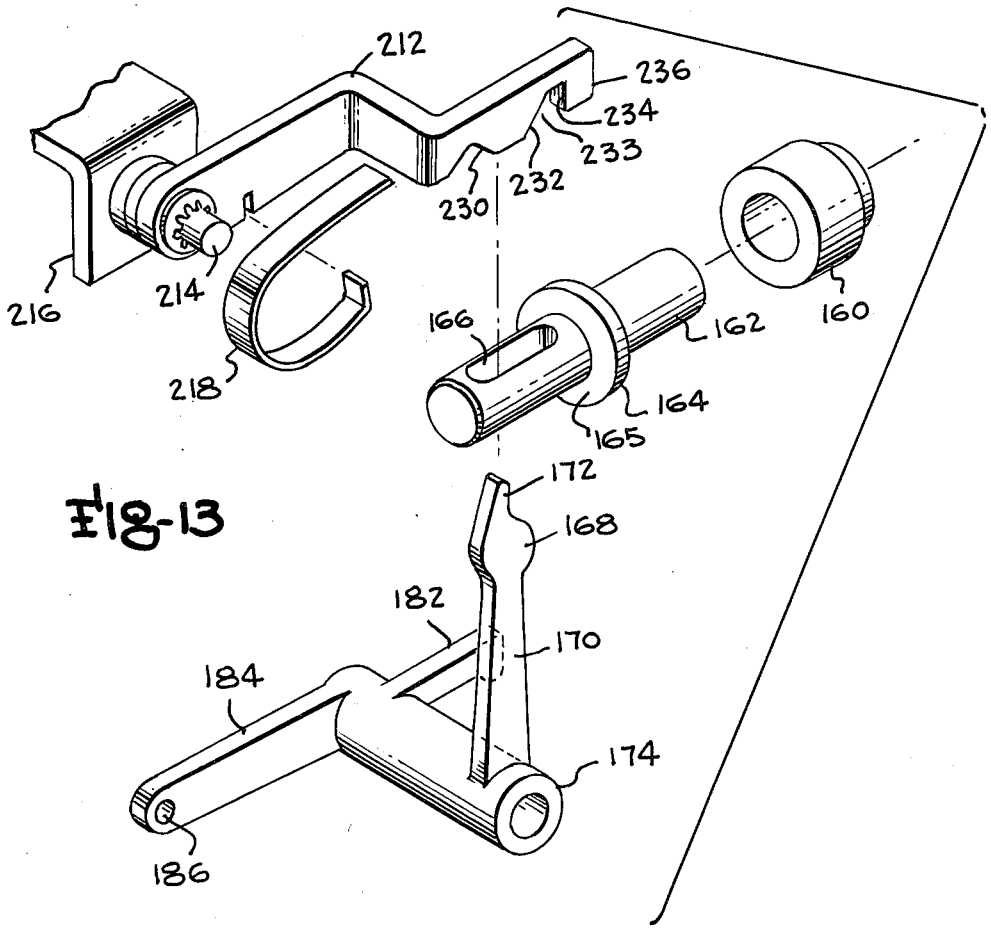
FIG. 13 is an exploded perspective view of the dead bolt and actuator and control means associated therewith.

Additionally, a deadlock latch 212 is mounted for pivotal movement on a pivot shaft 214 which is in turn mounted on a bracket 216 attached to and extending downwardly from the upper T-shaped head plate 82 as shown in FIG. 12. Deadlock latch 212 is biased on a clockwise direction by spring means 218. The deadlock latch 212 includes first and second camming surfaces 230 and 232 (FIG. 13) and also has a first or inner abutment surface 234 and a second or outer abutment surface 236 which surfaces are respectively engaged at different times with the first and second abutment surfaces 163 and 165 on opposite sides of the radial holding flanges 164 for either holding the dead bolt 162 in an extended locking position illustrated in FIG. 5 or a retracted unlocking position as shown in FIG. 12.

Dead bolt member 162 is positioned in its retracted or unlocking position illustrated in FIG. 12 by actuation of the unlock solenoid 204. As thus positioned, the inner abutment surface 234 engages the side of the radial bolt flange 164 to hold the dead bolt 162 in the retracted position illustrated in FIG. 12. If it is desired to extend the dead bolt 162 to its extended locking position, locking solenoid 196 is actuated, which actuation initially results in the movement of actuator arm 170 from its solid line position illustrated in FIG. 12 with this movement being made possible by the fact that the rounded drive portion 168 of the arm is not mechanically connected to the dead bolt 162 and is capable of a limited amount of free movement in drive slot 166. This free movement results in the engagement of camming surface 230 by the upper end of camming finger 172 to cause the deadlock latch 212 to move from its solid line position to its dotted line position of FIG. 12 before the drive portion 168 engages the end of the slot 166. Movement of the deadlock latch to the dotted position causes first abutment surface 234 to be completely lifted from contact with the radial bolt flange 164 so that continued movement of the actuator arm 170 after drive portion 168 reaches the end of slot 166 causes the dead bolt 162 to move to the right as viewed in FIG. 12 to its extended locking position illustrated in FIG. 5. Such rightward movement is stopped by engagement of the flange 164 with the side of the dead bolt support fitting 160. When the dead bolt 162 arrives at its extended locking position, the normally open contact 208A of the dead lock indication switch 208 will close by contact from drive arm 184 to actuate a blue indicator light B on the control panel to indicate that the dead bolt 162 is in its extended locking position; moreover, when the dead bolt 162 arrives at its extended position the finger 172 will have moved into the slot 233 in deadlock latch 212 between the second camming surface 232 and the first abutment surface 234 and the deadlock latch 212 will conseuqnetly be urged by spring 218 into the position illustrated in FIG. 5. As thus positioned, the second abutment surface 236 of latch 212 faces abutment surface 165 of the radial flange 164 so that any leftward movement of the bolt would result in engagement of the surface 165 with the surface 236 to prevent any further unlocking movement of the bolt. Consequently, bolt 162 cannot be forced from its locking position to its unlocking position.

If it is desired to move the dead bolt 162 to its retracted unlocking position, unlocking solenoid 204 is actuated and the actuator arm 170 moves within the slot 166 so that the finger 172 first engages the second camming surface 232 to lift the deadlock latch 212 upwardly to the dotted line position of FIG. 12 so that the surface 236 clears the flange 164 and the dead bolt 162 is then capable of being retracted to the left when the drive portion 168 engages the end of slot 166. Movement of drive arm 184 by actuation of solenoid 204 also serves to permit switch 208 to return to its open condition to deactivate indicator B.

A lock bolt 240 best illustrated in FIG. 14 is mounted for reciprocation in a rectangular opening 243 in a bolt support block 242 attached to the inner surface of plate 38'' with the opening 243 being aligned with an opening 245 in plate 38''. Bolt 240 has a canted cam surface 244 which permits reciprocation of the lock bolt 240 in opening 243 to a retracted or unlatched position illustrated in dotted lines in FIG. 8 upon closure of the door 14 against the cam surface in a well-known manner.

Lock bolt 240 also includes a transverse rear portion 246 having a slot 247 in which a downwardly extending cam follower bolt opening lug 248 is mounded by means of a threaded bolt end 250 and a nut 252. The opposite end of the bolt 250 is mounted in a slide bearing 256 fixed to a channel type support bracket 258 mounted on vertical back plate 80 as shown in FIG. 4. A compression spring 260 is mounted on bolt 250 and extends between bracket 258 and nut 252 so as to urge the lock bolt 240 outwardly to an extended or locking position best illustrated in FIG. 7.

A bolt drive pin 262 extends upwardly from the upper surface of the rear transverse portion 246 of the bolt member 240 through an elongated drive slot 264 in a connector plate 266 with a retainer means 268 being attached to the upper end of pin 262. The opposite end of the connector plate 266 has a drive opening 270 mounted on an eccentric drive pin 272 fixed to an output drive disc 274 keyed to an output shaft 276 of a step-down motor transmission unit 278. The step-down motor transmission unit 278 includes a motor 279 (FIG. 15) and electrical and mechanical drive control components which result in a single revolution of the output drive disc 274 for each actuation of the unit 278 by momentary operation of switch button 34. The arrangement is such that the parts 274, 266 etc. always stop following actuation of unit 278 in the position illustrated in FIG. 7 so that the lock bolt 240 is urged toward its extended position by the spring means 260; however, slot 264 permits lock bolt 240 to be moved to its retracted dotted line position of FIG. 8 in a manner that will be apparent from comparison of FIGS. 7 and 8.

Figure 15:
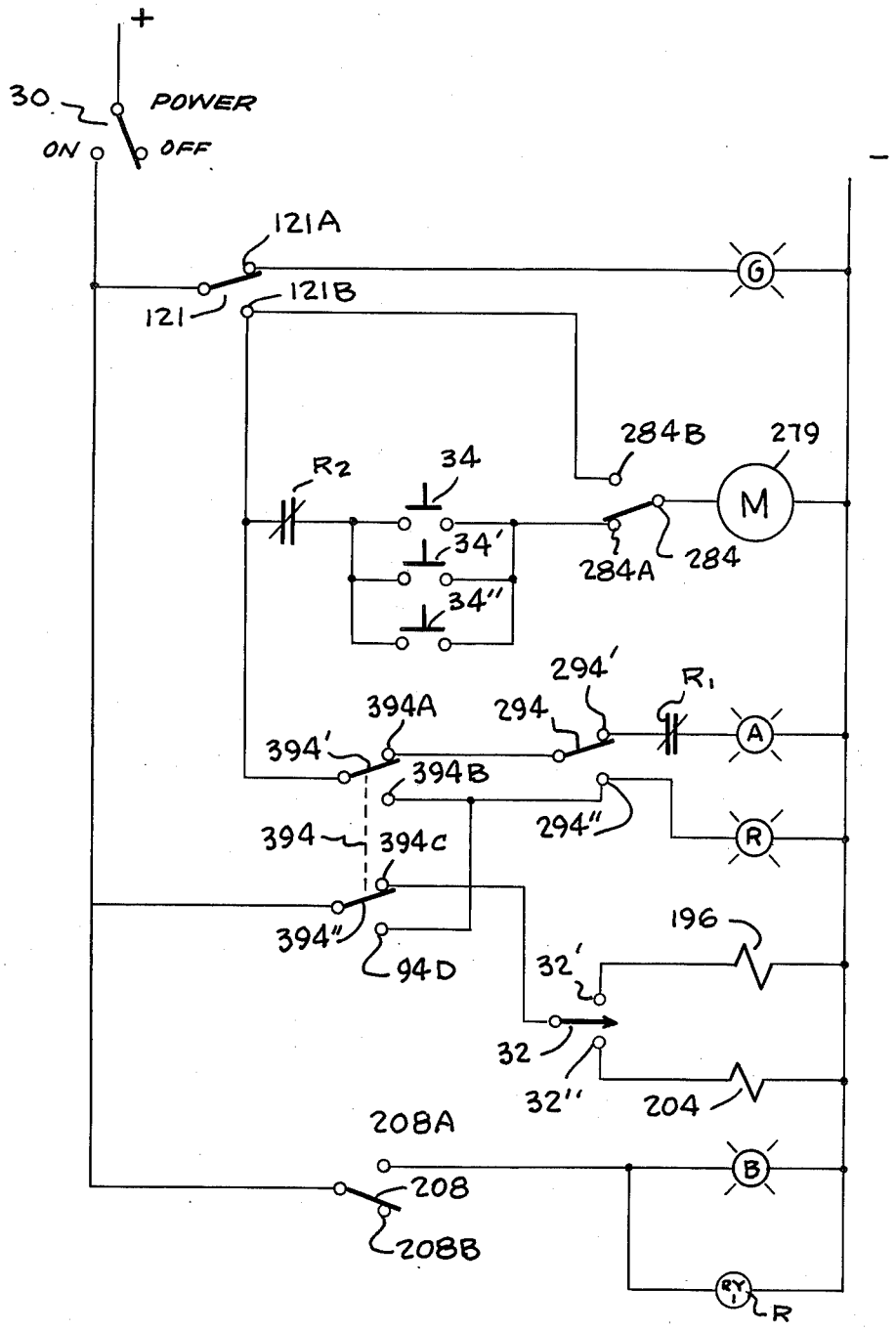
FIG. 15 is an electrical schematic of the control circuitry of the preferred embodiment.

When the parts are positioned in the manner illustrated in FIG. 7, a switch actuator plate 280 fixed to connector plate 266 engages the actuator 282 of a microswitch 284 having contacts 284A and 284B as shown in FIGS. 5 and 15 and drive pin 262 engages the actuator of a bolt limit microswitch 294 having contacts 294' and 294". Microswitch 284 is mounted on a switch bracket 286 attached to a relatively heavy support bracket 288 (FIG. 5) which is in turn fixedly connected to the back plate 80. Support bracket 288 also provides support for the step-down motor transmission unit 278 and for an electrical terminal block 290.

A lock lug 300 extends from the portion of the lock bolt 240 adjacent pin 262 and terminates in an abutment surface 301 with a similar abutment surface 301' being in vertical alignment therewith. Lug 300 includes a lock slot 302 as best shown in FIG. 4. Lock slot 302 is aligned with a mating fixed slot 304 provided in the bolt support block 242 when the lock bolt 240 is in its extended locking position as illustrated in FIG. 7. A deadlock lug 306 extending outwardly and downwardly from a deadlock mounting plate 308 is positionable in slots 302 and 304 when slots 302 and 304 are in the aligned position illustrated in FIG. 7 to prevent the opening of lock bolt 240.

Mounting plate 308 is attached to the upper end 310 of an elongated bolt release bar 312 by means of a threaded rod 314 and a nut 316. Bolt release bar 312 is of square cross-sectional configuration and is mounted in a mating square opening 318 in bolt support block 242 for vertical axial reciprocation. The lower end of latch release bar 312 has an inclined cam surface 320 positioned in vertical alignment below the cam follower lug 248 extending downwardly from the lock bolt member 240. Additionally, a lifter plate 317 is attached to the lower end of the bolt release bar 312 and is positioned beneath the hook portion 117 of lifter rod 116.

The upper end of threaded rod 314 is connected to a clevis 321 to which the end of a flexible steel cable 322 is connected. Cable 322 extends through cable chase 22 and is connected by a clevis 323 to the main control lever 28 as shown in FIG. 3.

Lever 28 includes a large handle portion 324 of round cross-section and a more narrow rectangular cross-section portion 325 to which the clevis 323 is connected. Portion 325 extends through a relatively narrow slot 326 in a retainer bracket 327 fixedly mounted to the wall 328 or other suitable support element in the building. A retainer pin 330 is fixedly mounted in the end of the narrow portion 325 on the interior of the bracket 327 so as to prevent removal of the handle portion 325 from the bracket beyond the dotted line position illustrated in FIG. 3. Pin 330 being longer than the width of the slot 326, the pin limits the extent of outward movement of the lever 28 in an obvious manner. However, the lever portion 325 can engage the upper or lower edge of slot 326 so that the engaged edge serves as a pivot point for the lever then the handle end 28 is pulled upwardly or downwardly.

It will be seen that movement of handle 28 serves to effect movement of the steel cable 322 on the rod 314 etc. attached to the cable. It should also be noted that the rod 314 has a floating dead bolt release collar 332 resting upon the upper end of a relatively stiff coil spring 333 the lower end of which is supported on a pin or cotter key 334 extending through the rod. The upper surface of the floating collar 332 is positioned to engage the emergency release arm 182 of the dead bolt actuator arm 170 when the rod 314 is moved upwardly by cable 322 for the purpose of pivoting the unitary members 182, 170 to effect movement of the dead bolt 162 to its retracted position. Rod 314 is biased downwardly by a compression spring 337 engaged with the lower side of a bearing support plate 338 carried on a bracket plate 339 and the nut 316 threaded on the rod 314 as previously discussed. It will be seen that the rod 314, bolt release bar 312 and their associated attachments comprise a bolt release and control member which is effective for controlling both of the bolt members in accordance with three operational and one maintenance position which it assumes under the control of handle 28.

Control panel 24 is provided with a slot in which the main control lever or handle 28 is mounted for selective positioning in the slot in three normal operational positions and one rarely used maintenance position. The operational slot positions respectively comprise an upper narrow portion 28D defining a DEADLOCK position for handle 28, a medial circular portion 28I defining an OPERATE position for handle 28, a lower narrow portion 28E for permitting the electrical or manual unlocking of the door at the door and a lower circular portion 28R defining a RELEASE position for handle 28. Additionally, a normally covered offset slot portion 28M defines a fourth rarely used MAINTENANCE RELEASE position for handle 28. The relatively narrow portions 28D and 28E are of slightly greater width than the thickness of narrow portion 325 of the lever 28 so that portion 25 can be positioned in these portions by being pulled outwardly by handle means 28 so that the larger handle portion 324 is external of panel 24 followed by pivotal movement of the handle 28 either up or down to either the DEADLOCK position 28D or the RELEASE position 28R. The extent of outward movement of the member 28 is limited by pin means 330 as previously discussed. The lever 28 can also be pivoted to the intermediate or OPERATE position corresponding to the circular opening 28I followed by inward movement of the handle 28 to position the cylindrical handle portion 324 in the circular opening 28I so that further pivotal movement of the level is prevented. The cylindirical handle portion 324 can be positioned in the circular release opening to be held therein in the exact same manner. Positioning of lever 28 in the OPERATE position is illustrated in FIGS. 2 and 3. Positioning of lever 28 in the lowermost MAINTENANCE RELEASE position in slot 28M is normally not permitted by virtue of the fact that a closure plate P is fixedly positioned over this slot portion. However, the closure plate P can be removed for permitting removal of the door locking and controlling module unit 23 for maintenance procedures as will be discussed hereinafter. Since the module cannot be removed unless lever 28 is placed in this position, the module is locked in place from the guard station at all times and cannot be removed solely by action taken at the door location.

A door detecting and biasing rod 340 is mounted for axial reciprocation between an external position (FIG. 8) and a retracted position (FIG. 7) in an opening in door jamb plate 42"; rod 340 is supported in a tubular member 342 mounted in block 88 as shown in FIG. 10. Upper and lower slots 347 are provided in the tubular support member 342 with stop pin means 346 mounted on rod 340 extending through the slots in member 342. Compression spring means 350 of substantial strength urges the door detection rod 340 outwardly to the extent permitted by slots 347 and stop pin means 346. It will be observed that the door detection rod is capable of movement of a recessed position illustrated in FIG. 7 which position is assumed by the rod in response to closure of the door 14 which physically engages the end of rod 340. When the bolts 162 and 240 are moved to their retracted positions, the force of spring 350 acting on rod 340 kicks the door 14 to an open position with the rod 340 moving outwardly to its extended position in which stop pin means 346 is aligned with an abutment surface 301 as illustrated in FIG. 8.

During the course of normal operation of the system, the main control lever 28 will be positioned at different times in a first position in the upper or DEADLOCK slot position 28D, a second position in the intermediate or OPERATE circular slot portion 28I or a third position in the EMERGENCY RELEASE slot portion 28R. Positioning of the main control lever 28 obviously causes a vertically reverse corresponding positioning of the threaded rod 314 and the bolt release bar 312 in a corresponding first or DEADLOCK position DL as shown in FIG. 9, a second or OPERATE position O and a third or RELEASE position R. The bolt release bar 312 as shown in FIG. 9 in its solid line position is in the OPERATE position IO effected by the positioning of the handle 324 of lever 28 in the slot portion 28I illustrated in FIGS. 2 and 3. As thus positioned, the bolt release bar 312 is in a sufficiently low position that its inclined cam portion 320 does not interfere with movement of the lock bolt 242 to its extended locking position which movement is effected by spring 260. It should also be noted that the positioning of lever 28 in its MAINTENANCE RELEASE position causes bolt release bar 312 to move to a corresponding position MR as illustrated in FIG. 9.

When lever 28 is in its OPERATE position and dead bolt 120 is in its retracted position, operation of the motor transmission unit 278 to cause bolt 240 to move to its retracted or unlocking position can be effected in several ways; firstly, by the depression of the lock bolt unlock switch button 34; secondly, by an inmate operator switch 34' on the interior of the cell; or thirdly, by a key controlled switch 34" on the exterior of the cell; or fourthly, by a key inserted in the door lock, on either the guard side or inmate side of the door.

Movement of the bolt 240 to its retracted position permits the door 214 to be automatically opened by rod 340. The inmate is then free to leave (or enter) the cell but can lock the cell door following passage through the doorway by simply closing the door against camming surface 244 with the spring 260 serving to return the lock bolt 240 to the locking position as the door moves to its fully closed position. Operation of the step-down motor transmission unit 278 is prevented by the control circuit when the dead bolt 162 is in its extended locking position.

It should be appreciated that the opening movement of the door 14 is caused by rod 340 which moves forward as the door opens to position the stop pin means 346 in the forward end of slot 347 as shown in FIG. 10; the foregoing movement of rod 340 occurs while the lock bolt 240 is approaching its inner extent of movement so that the stop pin means 346 are fully in position at the forward end of slot 347 when the bolt 240 is returned to its extended position by spring 260. Consequently, abutment surfaces 301 and 301' engage stop pin 346 to prevent further outward movement of bolt 240 and to keep the lock slot 302 from moving into alignment with deadlock lug 306 and fixed slot 304; consequently, deadlock lug 306 cannot be activated to move into slots 302, 314 until the door is closed to cause rod 340 to move to its retracted position of FIG. 7.

Additionally, a simple mechanical pusher bolt member 360 can be provided in the door lock unit for movement against the end of the lock bolt 240 upon turning movement of door handle 15 which is permitted by lock means in which the handle 15 is mounted. This permits the employment of a key in conventional lock means such as model 1080-1 and 1080-2 locks sold by the assignee of this invention, Southern Steel Company of San Antonio, Tex., followed by operation of door handle 15 or a similar handle inside or outside the cell to effect movement of the pusher bolt 360 to cause retraction of the lock bolt 240 to permit guard or inmate to open the door to return to or exit from the cell. However, other inmates not having a key would not be able to open the cell door. Key controlled electrically actuated locks could also be used to activate the lock bolt is desired.

It is obviously necessary that the ability of the inmate to unlock the door by pushbutton on the inside or by key in the door on the inside is solely controlled by the guard at the control station. Both electric key and manual key operation by inmate can be recaptured by putting lever in deadlock setting at the guard station. Such removal of the inmate's liberty to open and close the cell door 14 is accomplished in two ways. Firstly, by moving the main control lever 28 to the upper or DEADLOCK position in which the handle portion 325 is positioned in slot portion 28D or, secondly, by actuation of the dead bolt actuator switch 32. It should be understood that dead bolt latch solenoid 196 cannot be operated unless door 14 is in a closed position; similarly, if the door is open, the lock bolt deadlock 306 cannot move into slots 302, 304 to deadlock lock bolt 240. However, lever 28 can be moved to the DEADLOCK position even if door 14 is open, but such movement does not effect deadlocking of lock bolt 240 until such time as the door is closed. Movement of lever 28 to the DEADLOCK position of the handle permits the rod 314 and bolt release bar 312 to be urged and moved downwardly by spring means 337 toward position DL of FIG. 9 to activate switch 121.

If the door 14 is closed at the time the main control lever 28 is moved to the DEADLOCK position, slots 302 and 304 will be in their aligned position so that downward movement of the bolt release bar 312 will cause the deadlock lug 306 to move into slots 302 and 304 and consequently immediately lock bolt 240.

On the other hand, if the door 14 is open at the time the guard moves the deadlock lever to the deadlock position, rod 340 will be in its extended position so that abutment surfaces 301 and 301' will engage pin means 346 and slots 302 and 304 will not be aligned and the lower surface of deadlock lug 306 will simply rest on the upper surface of member 300. However, upon closure of the door 14, the abutment pin 346 will be pushed by the door to the position illustrated in FIG. 7 to permit the lock bolt 240 to be moved by spring 260 fully to the extended position in which slot 302 is aligned with slot 304 to consequently permit deadlock lug 306 to fall into the aligned slots 302, 304 to deadlock the lock bolt 240 and hold it in its extended locking position. The guard can also actuate the electrical deadlock switch 32 to effect actuation of latch solenoid 196 to extend the dead bolt to its extended locking position illustrated in FIG. 5; however, the control circuitry prevents such movement of the bolt 162 unless the door is fully closed. It is essential that the dead deadlock 162 not be movable to its extended position and the lock bolt not be deadlocked when the door is opened so as to prevent the inmates from damaging the bolts by slamming the door against the bolts.

While the dead bolt 162 and the lock bolt 240 are normally operated by electrical means from the control station, it is essential that both bolts 162 and 240 be capable of being moved to their unlocked position mechanically in the event of an electrical power failure. Such movement is accomplished by movement of the main control lever to its third or RELEASE position in which the narrow portion 325 of the lever is positioned in lower slot portion 28R with such movement causing the rod 214 to be moved upwardly by cable 322 to the RELEASE position R (FIG. 9) so that the floating collar 332 engages the lower surface of the emergency release arm 182 to pivot the actuator arm 170 to the solid line position illustrated in FIG. 12 to mechanically retract the dead bolt 162 to the same position that would be assumed by the arm as a result of actuation of the unlock solenoid 204. Obviously, the compression spring 133 is of sufficient strength to exert adequate force on the floating collar 332 to cause pivotal movement of the actuator rod 170 etc. to its unlocking position.

The upward movement of the rod 214 also causes the latch release bar 312, the deadlock lug 306 and the inclined cam surface 320 to move upwardly so that surface 320 engages the cam follower lug 248 to move the lock bolt 240 to its retracted position in a obvious manner so that the door will immediately spring open.

When it is necessary to service module 23, plate P is removed from the control panel and handle 28 is moved to the MAINTENANCE RELEASE position 28M with such movement causing the lifter plate 317 to engage hook portion 117 to lift the hook portion, plate 118 and the assembly lock pins 108 and 110 upwardly so that the lock pins move from and clear the retainer openings 74, 75 provided in the support lugs 72 and 73. The lower end of the door locking and controlling unit can then be pivoted outwardly from the control assembly housing 21 to permit replacement or repair of the locking and controlling module 23. The module is returned to its operating position by initially positioning the flange members 136, 138, 139 and 140 respectively beneath plates 38, 42, 39 and 40 followed by swinging movement of the lower end of the unit into position while the main control lever is moved from the maintenance release position to any one of the other positions to permit the cable 322 to lower means 312, 117 and 118 to move the locking pins 108 and 110 into the retainer flanges 74 and 75.

FIG. 15 illustrates the control circuitry which permits the control of the dead and lock bolt members so that the dead bolt 162 can only be extended when the door 14 is in a closed position while permitting operation of the lock bolt 240 when the main control lever 28 is in the OPERATE position. In addition to the previously discussed control circuit elements, it will be noted that the control panel 24 includes a green manual deadlock indicator lamp G which, when activated, indicates that the deadlock lug 306 is positioned in the aligned slots 302, 304 for dead locking the lock bolt 240 in its extended locking position. Additionally, the circuit includes an amber operate indicator lamp A which, when activated, indicates that the system is in the operate mode of operation with the main control lever in the intermediate position for permitting the opening and closing of door 14 and a red indicator lamp R which is activated to indicate that the door is in an open condition. Lastly, the control circuit also includes a door operated door position limit switch 394 mounted in the door frame or otherwise positioned to be engaged by the door to indicate that the door is either open or closed. The door position limit switch 394 includes mechanically connected first and second movable switch elements 394' and 394" with element 394' being engaged with a contact 394A when the door is in a closed position and with a contact 394B when the door is in an open position and element 394" being engaged with contact 394C when the door is closed and with contact 394D when the door is opened. A relay R has normally closed contacts R1 and R2 with the relay being positioned in parallel with a blue dead bolt actuate indicator lamp B for simultaneous actuation upon closure of the movable switch element of switch 297 against its contact 208A caused by actuation of the lock solenoid 196.

If it is assumed that the main power switch 30 is in its on condition and the control lever 28 is in the DEADLOCK position with the door 14 closed and the dead bolt 162 retracted with the switch elements being as shown. Switch 121 will have its switch element in contact 121A to activate the manual deadlock indicator lamp G and the lock bolt unlock switch 34 at the console and the operate switch 34' and the key switch 34" will all be inoperable for actuating the motor 279 due to the positioning of switch 121. In this position, the bolt 240 is the only bolt that is deadlocked; however, the guard has the option of activating the dead bolt actuator switch 32 to move its movable member into engagement with the contact 32' to actuate locking solenoid 196 to immediately extend the dead bolt 162 to its locking position illustrated in FIG. 5.

Actuation of locking solenoid 196 causes the drive arm 184 to engage the dead bolt indicator microswitch 208 to move its movably switching member into engagement with contact 208A to simultaneously actuate the blue dead bolt extended indicator lamp B and the relay R; actuation of relay R opens contacts R1 and R2 which has no immediate effect upon the circuit at that time. The system is then in its maximum security condition with both of the bolts 162 and 240 being deadlocked in their extended positions; however, if a power failure occurs, it is possible for the guard to manually unlock both of the bolt members by pulling the main control lever downwardly to the RELEASE position to cause bolt release collar 332 to move upwardly to engage emergency release arm 182 to retract dead bolt 162 and to simultaneously cause inclined cam 320 to engage cam follower lug 248 to retract the lock bolt 240.

Assuming bolts 162 and 240 are extended and it is desired to give the inmate freedom to come and go from the cell, the main control lever 28 will be moved to the OPERATE position so that the movable element of switch 121 will be disengaged from contact 1212A and will engage contact 121B to deactivate the green manual deadlock indicator lamp G; however, since the relay contacts R2 are open, there is no way in which the motor 279 can be actuated and the dead bolt remains in its extended locking position to prevent opening of door 14. In order for the system to be placed in the OPERATE position, it is consequently necessary for the guard to move the movable member of electrical deadlock switch 32 into engagement with contact 32" to activate the unlock solenoid 204. It should be noted at this juncture that the movable element of switch 32 is normally maintained in a neutral position in which it is not in contact with either of the contacts 32' or 32".

Actuation of the unlock solenoid 204 immediately retracts the dead bolt 162 to permit the movable element of switch 208 to return to its normal condition engaged with contact 208B to consequently deactivate the blue dead bolt extended indicator B and the relay R. Deactivation of relay R results in closure of the relay contact R2 to permit the lock bolt actuator switches 34, 34' and 34" to be actuated to actuate the motor 279 to retract the lock bolt. Additionally, in some installations the bolt 34 can also be retracted by operation of handle 15 to actuate pusher bolt 360. Normally, economy would dictate that a system would not have both electrical actuators 34' and 34" in conjunction with a mechanical actuator for bolt 360 although it would be feasible to use all of the disclosed operated lock bolt actuators if desired. After the initial movement of the bolt 240 from its extended position toward its retracted position, the switch 284 is shifted to bring its movable member into engagement with contact 284B so that the motor 279 continues to operate although the switch members 34 etc. may have been released; however, return of the drive pin 262 moves the movable switch element of switch 284 back into engagement with contact 284A as the bolt 240 returns to its extended position but since the switch 34 will have been released at this time, the motor 279 is consequently deactivated and the lock bolt remains in its extended position. Closing of the relay contacts R1 results in actuation of the amber operate indicator lamp A.

Additionally, it should be understood that when the lock bolt 240 clears the opening within the door 214, the compression spring 350 will cause rod 340 to kick the door open with the opening movement of the door serving to actuate switch 394 to move the movable switch element 394' into engagement with contact 394B and to also move the movable switch element 394" into engagement with contact 394D with the result of this movement being actuation of the red indicator lamp R and a disabling of the switch 32 since it will no longer be connected to a voltage source. Since switch 32 is desirable, it is consequently impossible to activate the locking solenoid 196 to extend the dead bolt 162 while the door is in its open position. If the inmate leaves his cell and closes door 14, the lock bolt 340 will be retracted by engagement of the edge of the door with the camming surface 244. In this condition, the only way that the door can be opened is by switch elements 34, 34', 34" or by handle 15 with switch elements 34', 34" and handle 15 all being operable by the guard or inmate if desired.

Thusly, the inventive system permits the guard to give the inmate the freedom to come and go from the cell at the discretion of the guard. It is impossible for the bolt members 162 and 240 to be extended while the cell door is open and it is therefore impossible for the inmate to damage the bolt members. In the event of need for maintenance of the bolt control and locking means, the entire unit can be removed by positioning of the main control lever 28 in the MAINTENANCE RELEASE position to lift the lock pins 108 and 110 from locking engagement in the lugs 72. With the door in open position, the module 23 can then easily be titled upwardly and outwardly from the door frame.

Numerous modifications of the preferred embodiment of the invention will undoubtedly occur to those of skill in the art. Therefore, it should be understood that the spirit and scope of the invention is to be limited solely by the appended claims.

We claim:

1. A door control system including:

a door frame;

a door mounted in said door frame;

a dead bolt mounted in said door frame for movement between an extended door locking position in which one end of the dead bolt extends into a mating opening in the door and a retracted unlocking position;

a lock bolt mounted in the door frame for movement between an extended door locking position in which the lock bolt extends into a mating opening in the door and a retracted unlocking position;

a control station spaced from said door frame;

control effecting connection means extending between said control station and said door frame;

selectively operable dead bolt actuator means in said door frame for actuating said dead bolt to effect movement of said dead bolt to either its extended position or its retracted position;

selectively operable lock bolt positioning means mounted in said door frame unit for moving said lock bolt to its retracted position;

a manually operable lever member mounted in said control station for selective movement to a first position, a second position and a third position;

a movable bolt release and control member mounted in said door frame for movement to first, second, and third positions;

said latch control effecting connection means being connected to said bolt control actuator member and including mechanical connector means extending between said manually operable lever member and said bolt release and control member for positioning said bolt release and control member in its first, second or third positions in response to the positioning of said manually operable lever member respectively in its first, second or third positions;

dead bolt release means engageable with means on said bolt release and control member for moving said dead bolt to its retracted position in response to movement of said bolt release and control member to its third position;

lock bolt release means responsive to movement of said bolt release and control member to its third position for moving said lock bolt to its retracted position;

lock bolt biasing means for urging said lock bolt toward its extended latching position; and lock bolt drive override means responsive to the positioning of said dead bolt in its extended door latching position for preventing operation of said lock bolt positioning means.

2. The invention of claim 1, additionally including spring means urging said bolt release and control member toward its first position; and wherein said lock bolt is a bevel bolt having a canted surface engaged by the door during closure of the door to effect momentary movement of the lock bolt to its retracted position.

3. The invention of claim 1, additionally including:

a dead bolt deadlock engageable with said dead bolt for deadlocking said dead bolt in its extended door locking position.

4. The invention of claim 3, additionally including:

a lock bolt deadlock engageable with said lock bolt for deadlocking said lock bolt in its extended position.

5. The invention of claim 4, additionally including:

a lock bolt support block;

said lock bolt being mounted in said lock bolt support block for reciprocation between its extended and retracted positions;

a fixed slot in said bolt support block facing said lock bolt;

a lock slot on said lock bolt facing said fixed slot and aligned therewith when said lock bolt is in its extended position;

said lock bolt deadlock comprising a lock lug aligned with said fixed slot and movable into a locking position in said fixed slot and said lock slot when they are aligned when said lock bolt is in its extended position for locking said lock bolt in its extended position; and means on said lock bolt for preventing movement of said lock lug into said locking position when said lock bolt is not in its extended position.

6. The invention of claim 5, additionally including:

a door detecting and biasing rod mounted for reciprocation in said door frame between an extended position and a retracted position;

rod biasing means urging said door detecting and biasing rod toward its extended position;

said door detecting and biasing rod being positioned to be engaged by said door which moves said rod to its retracted position when said door is closed; and stop pin means on said door detecting and biasing rod positioned to be engaged by an abutment surface of said lock bolt when said door detecting and biasing rod is in any position other than its extended position for preventing movement of said lock bolt to its extended position.

7. The invention of claim 6, wherein:

said dead bolt comprises an elongated member having an elongated drive slot extending transversely therethrough;

said dead bolt actuator includes:

an actuator arm, pivot means supporting one end of said actuator arm, a free opposite end of said actuator arm loosely extending through said drive slot and being of a width less than the length of said drive slot so as to have a limited amount of free play movement therein, said actuator arm terminating in a camming finger positioned outwardly of said drive slot; and solenoid means for selectively pivoting said actuator arm to a first position effecting movement of said dead bolt to its retracted position and a second position effecting movement of said dead bolt to its extended position.

8. The invention of claim 7, wherein said dead bolt is generally of cylindrical configuration and includes a radial flange portion.

9. The invention of claim 7, wherein said dead bolt release means includes:

an emergency release arm fixedly connected to said actuator arm and having a portion positioned adjacent said bolt release member when said actuator arm is in its second position; and pusher means on said movable bolt release arm engageable with said portion of said emergency release arm during movement of said bolt release and control member from its second position to its third position for pivoting said release arm to move said actuator arm to its first position to consequently effect movement of said dead bolt to its retracted position.

10. The invention of claim 9, wherein said dead bolt deadlock comprises:

an elongated member pivotally supported on one end for movement between a locking position adjacent said dead bolt and a bolt freeing position spaced from and not contacting said dead bolt and having first and second abutment surfaces respectively engageable with opposite sides of said radial flange when the deadlock is in its locking position for deadlocking said dead bolt in either its extended or retracted positions.

11. The invention of claim 10, wherein said deadlock includes camming surfaces negageable by said camming finger during the initial movement of said actuator arm from either of its first or second positions toward the other position for moving said deadlock outwardly to its freeing position during freeplay movement of the actuator arm in the drive slot prior to the initiation of movement of said dead bolt as the actuator arm reaches the end of the drive slot to drivingly engage same.

12. The invention of claim 1, additionally including spring means urging said bolt release and control member toward its first position;

wherein said lock bolt is a bevel bolt having a canted surface engaged by the door during closure of the door to effect momentary movement of the lock bolt to its retracted position; and further including a dead bolt deadlock latch engageable with said dead bolt for deadlocking said dead bolt in its extended door locking position and for deadlocking said dead bolt in its retracted unlocking position.

13. The invention of claim 12, additionally including:

a lock bolt deadlock engageable with said lock bolt for deadlocking said lock bolt in its extended position.

14. The invention of claim 13, additionally including:

a lock bolt support block;

said lock bolt being mounted in said lock bolt support block for reciprocation between its extended and retracted positions;

a fixed slot in said bolt support block facing said lock bolt;

a lock slot on said lock bolt facing said fixed slot and aligned therewith when said lock bolt is in its extended position;

said lock bolt deadlock comprising a lock lug aligned with said fixed slot and movable into a locking position in said fixed slot and said lock slot when said slots are aligned when said lock bolt is in its extended position for locking said lock bolt in its extended position; and means for preventing movement of said lock lug into said locking position when said lock bolt is not in its extended position.

15. The invention of claim 14, additionally including:

a door detecting and biasing rod mounted for reciprocation in said door frame between an extended position and a retracted position;

rod biasing means urging said door detecting and biasing rod toward its extended position;

said door detecting and biasing rod being positioned to be engaged by said door upon closure of the door to move said rod to its retracted position; and stop pin means on said door detecting and biasing rod positioned to be engaged by an abutment surface of said lock bolt when said door detecting and biasing rod is in any position other than its extended position for preventing said lock bolt having biasing means from moving said lock bolt beyond an intermediate non-deadlockable door locking position.

16. The invention of claim 15, wherein:

said dead bolt comprises an elongated member having an elongated drive slot extending transversely therethrough;

said dead bolt actuator includes:

an actuator arm, pivot means supporting one end of said actuator arm, a free opposite end of said actuator arm loosely extending through said drive slot and being of a width less than the length of said drive slot so as to have a limited amount of freeplay movement in said drive slot, said actuator arm terminating in a camming finger positioned outwardly of said drive slot; and solenoid means for selectively pivoting said actuator arm to a first position effecting movement of said dead bolt to its retracted position and a second position effecting movement of said dead bolt to its extended position.

17. The invention of claim 16, wherein said dead bolt release means includes:

an emergency release arm fixedly connected to said actuator arm and having a portion positioned adjacent said bolt release member when said actuator arm is in its second position; and pusher means on said movable bolt release arm engageable with said portion of said emergency release arm during movement of said bolt release and control member from its second position to its third position for pivoting said release arm to move said actuator arm to its first position to consequently effect movement of said dead bolt to its retracted position.

18. The invention of claim 17, wherein said dead bolt deadlock latch comprises:

an elongated member pivotally supported on one end for movement between a locking position adjacent said dead bolt and a bolt freeing position spaced from and not contacting said dead bolt and having first and second abutment surfaces respectively engageable with said dead bolt when the deadlock is in its locking position for deadlocking said dead bolt in either its extended or retracted positions.

19. The invention of claim 18, wherein said dead bolt deadlock latch includes camming surfaces engageable by said camming finger during the initial movement of said actuator arm from either of its first or second positions toward the other position for moving said deadlock outwardly to its freeing position during freeplay movement of the actuator arm in the drive slot prior to the initiation of movement of the actuator arm in the drive slot prior to the initiation of movement of said dead bolt as the actuator arm reaches the end of the drive slot to drivingly engage same.

20. The invention of claim 12, wherein said lock bolt positioning means includes:

a drive pin mounted on said lock bolt;

a drive link having an elongated slot on one end slidingly fitted over said drive pin; and a driven rotary member connected to an opposite end of said drive link which is rotated to move said drive link to effect movement of the drive pin and the lock bolt to the retracted position of the lock bolt.

21. The invention of claim 20, additionally including:

a lock bolt deadlock engageable with said lock bolt for deadlocking said lock bolt in its extended position.

22. The invention of claim 21, additionally including:

a lock bolt support block;

said lock bolt being mounted in said lock bolt support block for reciprocation between its extended and retracted positions;

a fixed slot in said bolt support block facing said lock bolt;

a lock slot on said lock bolt facing said fixed slot and aligned therewith when said lock bolt is in its extended position;

said lock bolt deadlock comprising a lock lug aligned with said fixed slot and movable into a locking position in said fixed slot and said lock slot when said slots are aligned when said lock bolt is in its extended position for locking said lock bolt in its extended position; and means for preventing movement of said lock lug into said locking position when said lock bolt is not in its extended position.

23. The invention of claim 22, additionally including:

a door detecting and biasing rod mounted for reciprocation in said door frame between an extended position and a retracted position;

rod biasing means urging said door detecting and biasing rod toward its extended position;

said door detecting and biasing rod being positioned to be engaged by said door upon closure of the door to move said rod to its retracted position; and stop pin means on said door detecting and biasing rod positioned to be engaged by an abutment surface of said lock bolt when said door detecting and biasing rod is in any position other than its extended position for preventing said lock bolt biasing means from moving said lock bolt beyond an intermediate non-deadlockable door locking position.

24. The invention of claim 23, wherein:

said dead bolt comprises an elongated member having an elongated drive slot extending transversely therethrough;

said dead bolt actuator includes:

an actuator arm, pivot means supporting one end of said actuator arm, a free opposite end of said actuator arm loosely extending through said drive slot and being of a width less than the length of said drive slot, said actuator arm terminating in a camming finger positioned outwardly of said drive slot; and solenoid means for selectively pivoting said actuator arm to a first position effecting movement of said dead bolt to its retracted position and a second position effecting movement of said dead bolt to its extended position.

25. The invention of claim 20, wherein:

said dead bolt comprises an elongated member having an elongated drive slot extending transversely therethrough; and said dead bolt actuator includes:

an actuator arm, pivot means supporting one end of said actuator arm, a free opposite end of said actuator arm loosely extending through said drive slot and being of a width less than the length of said drive slot so as to have a limited amount of freeplay movement in said drive slot, said actuator arm terminating in a camming finger positioned outwardly of said drive slot;

first solenoid means for selectively pivoting said actuator arm first through a freeplay movement in said slot followed by driving engagement with the dead bolt to a first position effecting movement of said dead bolt to its retracted position;

second solenoid means for selectively pivoting said actuator arm from its first position first through a freeplay movement in said slot followed by driving engagement with the dead bolt to a second position effecting movement of the dead bolt to its extended position; and wherein said dead bolt deadlock latch comprises a pivotable member movable between a locking position and an unlocking position with respect to said dead bolt including means engageable with said camming finger immediately following actuation of said solenoid means for moving said dead bolt deadlock latch to its retracted position during the freeplay movement of said actuator arm in said slot.

26. The invention of claim 25, additionally including:

a lock bolt deadlock engageable with said lock bolt for deadlocking said lock bolt in its extended position.

27. The invention of claim 1, additionally including modular frame means removably mounted in said door frame wherein said dead bolt, said dead bolt actuator, said lock bolt, said lock bolt positioning means, said movable bolt release and control member, said dead bolt release means, said lock bolt release means and said lock bolt biasing means are mounted on said modular frame means to define a modular unit, said door frame including support means supporting and removably mounting said modular unit in said door frame, modular unit locking means for locking said modular unit in said door frame, and locking means release means for unlocking said locking means to permit removal of said modular unit from said door frame in response to movement of said lever to a fourth position for actuating said locking means release means.

28. The invention of claim 27, wherein said modular unit additionally includes spring means urging said bolt release and control member toward its first position; and wherein said lock bolt is a bevel bolt having a canted surface engaged by the door during closure of the door to effect momentary movement of the lock bolt to its retracted position.

29. The invention of claim 28, wherein said modular unit additionally includes a dead bolt deadlock engageable with said bolt for deadlocking said dead bolt in its extended door locking position.

30. The invention of claim 29, wherein said modular unit additionally includes a lock bolt deadlock engageable with said lock bolt for deadlocking said lock bolt in its extended position.

31. The invention of claim 30, wherein said modular unit additionally includes:

a lock bolt support block;

said lock bolt being mounted in said lock bolt support block for reciprocation between its extended and retracted positions;

a fixed slot in said bolt support block facing said lock bolt;

a lock slot on said lock bolt facing said fixed slot and aligned therewith when said lock bolt is in its extended position;

said lock bolt deadlock comprising a lock lug aligned with said fixed slot and movable into a locking position in said fixed slot and said lock slot when they are aligned when said lock bolt is in its extended position for locking said lock bolt in its extended position; and means on said lock bolt for preventing movement of said lock lug into said locking position when said lock bolt is not in its extended position.

32. The invention of claim 31, wherein said modular unit additionally includes:

a door detecting and biasing rod mounted for reciprocation in said door frame between an extended position and a retracted position;

rod biasing means urging said door detecting and biasing rod toward its extended position;

said door detecting and biasing rod being positioned to be engaged by said door which moves said rod to its retracted position when said door is closed; and stop pin means on said door detecting and biasing rod positioned to be engaged by an abutment surface of said lock bolt when said door detecting and biasing rod is in any position other than its extended position for preventing movement of said lock bolt to its extended position.

33. The invention of claim 32, wherein:

said dead bolt comprises an elongated member having an elongated drive slot extending transversely therethrough;

said dead bolt actuator includes:

an actuator arm, pivot means supporting one end of said actuator arm, a free opposite end of said actuator arm loosely extending through said drive slot and being of a width less than the length of said drive slot so as to have a limited amount of freeplay movement therein, said actuator arm terminating in a camming finger positioned outwardly of said drive slot; and solenoid means for selectively pivoting said actuator arm to a first position effecting movement of said dead bolt to its retracted position and a second position effecting movement of said dead bolt to its extended position.

34. The invention of claim 27, wherein said locking means includes movable pin means mounted on said modular unit positionable in fixed mating means in said door frame to lock said modular unit in said door frame and said locking means release means includes a lifter plate mounted on said movable bolt release and control member which engages said movable pin means to effect disengagement of said movable pin means from said fixed mating means in said door frame.

35. The invention of claim 34, wherein said modular unit additionally includes spring means urging said bolt release and control member toward its first position; and wherein said lock bolt is a bevel bolt having a canted surface engaged by the door during closure of the door to effect momentary movement of the lock bolt to its retracted position.

36. The invention of claim 35, wherein said modular unit additionally includes a dead bolt deadlock engageable with said dead bolt for deadlocking said dead bolt in its extended door locking position.

37. The invention of claim 36, wherein said modular unit additionally includes a lock bolt deadlock engageable with said lock bolt for deadlocking said lock bolt in its extended position.

38. The invention of claim 37, wherein said modular unit additionally includes:

a lock bolt support block;

said lock bolt being mounted in said lock bolt support block for reciprocation between its extended and retracted positions;

a fixed slot in said bolt support block facing said lock bolt;

a lock slot on said lock bolt facing said fixed slot and aligned therewith when said lock bolt is in its extended position;

said lock bolt deadlock comprising a lock lug aligned with said fixed slot and movable into a locking position in said fixed slot and said lock slot when they are aligned when said lock bolt is in its extended position for locking said lock bolt in its extended position; and means on said lock bolt for preventing movement of said lock lug into said locking position when said lock bolt is not in its extended position.

39. The invention of claim 38, wherein said modular unit additionally includes:

a door detecting and biasing rod mounted for reciprocation in said door frame between an extended position and a retracted position;

rod biasing means urging said door detecting and biasing rod toward its extended position;

said door detecting and biasing rod being positioned to be engaged by said door which moves said rod to its retracted position when said door is closed; and stop pin means on said door detecting and biasing rod positioned to be engaged by an abutment surface of said lock bolt when said door detecting and biasing rod is in any position other than its extended position for preventing movement of said lock bolt to its extended position.

40. Locking means comprising bolt support means, a bolt mounted in said bolt support means for axial reciprocation between a retracted unlocking position and an extended locking position, a pivot support, an actuator arm having one end mounted on said pivot support and having a remote portion engageable with said bolt for moving said bolt between its retracted and extended positions upon pivotal movement of said actuator arm, solenoid means connected to said actuator arm for moving said actuator arm to effect movement of said bolt to either its extended or retracted position, a deadlock latch positioned adjacent said bolt, biasing means urging said deadlock latch toward said bolt, first and second abutment surfaces on said bolt, first and second abutment surfaces on said deadlock latch, said first abutment surface of said deadlock latch engaging said first abutment surface of said bolt for preventing movement of said bolt from its extended position, said second abutment surface of said deadlock latch engaging said second abutment surface of said bolt when said bolt is in its retracted position for preventing movement of said bolt toward its extended position and camming means on said actuator arm engageable with a cam surface on said deadlock latch for initially moving said deadlock latch to its retracted position upon actuation of said solenoid means to permit said actuator arm to subsequently move said bolt from one of its positions to the other of its positions.

41. The invention of claim 40, wherein said bolt includes an elongated slot, said remote portion of said actuator arm being positioned in said elongated slot having freeplay movement from one end of the elongated slot to the opposite end thereof.

42. The invention of claim 41, wherein said first and second abutment surfaces on said bolt comprise opposite sides of a radial flange on said bolt.

43. The invention of claim 42, wherein said bolt is of cylindrical configuration.

44. A door locking system comprising a door frame, a hingedly supported door mounted on said door frame, a dead bolt mounted on said door frame for movement between a retracted unlocking position and an extended locking position with respect to said door, drive means for moving said dead bolt to its extended position and means operable in response to the door being in an open position for preventing operation of said drive means.

45. A door control system including:

a door frame;

a door mounted in said door frame;

a dead bolt mounted in said door frame for movement between an extended door locking position in which one end of the dead bolt extends into a mating opening in the door and a retracted door unlocking position;

a lock bolt mounted in the door frame for movement between an extended door locking position in which the lock bolt extends into a mating opening in the door and a retracted door unlocking position;

a control station spaced from said door frame;

control effecting connection means extending between said control station and said door frame;

selectively operable dead bolt actuator means in said door frame for actuating said dead bolt to effect movement of said dead bolt to either its extended position or its retracted position;

selectively operable lock bolt positioning means mounted in said door frame unit for drivingly moving said lock bolt to its retracted position;

first actuator means at said control station for actuating said selectively operable lock bolt positioning means;

second actuator means in the vicinity of said door for actuating of said selectively operable lock bolt positioning means;

a manually operable lever member mounted in said control station for selective movement to a first position, a second position and a third position;

a movable bolt release and control member mounted in said door frame for movement to first, second and third positions;

said latch control effecting connection means including cable means extending between said bolt release and control member and said manually operable lever member for positioning said bolt release and control member in its first, second or third positions in response to the positioning of said manually operable lever member respectively in its first, second or third positions;

dead bolt release means engageable with means on said bolt release and control member for moving said dead bolt to its retracted position in response to movement of said bolt release and control member to its third position;

lock bolt release means responsive to movement of said bolt release and control member to its third position for moving said lock bolt to its retracted position;

lock bolt biasing means for urging said lock bolt toward its extended latching position; and lock bolt drive override means responsive to the positioning of said dead bolt in its extended door latching position for preventing operation of said lock bolt positioning means.

46. The invention of claim 45, additionally including:

a lock bolt deadlock engageable with said lock bolt for deadlocking said lock bolt in its extended door locking position in response to the positioning of said manually operable lever in its first position and the positioning of said door in its closed position.

47. The invention of claim 46, additionally including:

a dead bolt deadlock engageable with said lock bolt for deadlocking said lock bolt in its extended position.

48. The invention of claim 47, additionally including:

a lock bolt support block;

said lock bolt being mounted in said lock bolt support block for reciprocation between its extended and retracted positions;

a fixed slot in said bolt support block facing said lock bolt;

a lock slot on said lock bolt facing said fixed slot and aligned therewith when said lock bolt is in its extended position;

said lock bolt deadlock comprising a lock lug aligned with said fixed slot and movable into a locking position in said fixed slot and said lock slot when said slots are aligned when said lock bolt is in its extended position for locking said lock bolt in its extended position; and means on said lock bolt for preventing movement of said lock lug into said locking position when said lock bolt is not in its extended position.

49. The invention of claim 48, additionally including:

a door detecting and biasing rod mounted for reciprocation in said door frame between an extended position and a retracted position;

rod biasing means urging said door detecting and biasing rod toward its extended position;

said door detecting and biasing rod being positioned to be engaged by said door which moves said rod to its retracted position when said door is closed; and stop pin means on said door detecting and biasing rod positioned to be engaged by an abutment surface of said lock bolt when said door detecting and biasing rod is in any position other than its extended position for preventing movement of said lock bolt to its extended position.

50. The invention of claim 49, wherein:

said dead bolt comprises an elongated member having an elongated drive slot extending transversely therethrough;

said dead bolt actuator includes:

an actuator arm, pivot means supporting one end of said actuator arm, a free opposite end of said actuator arm loosely extending through said elongated drive slot and being of a width less than the length of said drive slot so as to have a limited amount of freeplay movement therein, said actuator arm terminating in a camming finger positioned outwardly of said drive slot; and solenoid means for selectively pivoting said actuator arm to a first position effecting movement of said dead bolt to its retracted position and a second position effecting movement of said dead bolt to its extended position.

51. The invention of claim 50, wherein said dead bolt is generally of cylindrical configuration and includes a radial flange portion.

52. The invention of claim 50, wherein said dead bolt release means includes:

an emergency release arm fixedly connected to said actuator arm and having a portion positioned adjacent said bolt release member when said actuator arm is in its second position; and pusher means on said movable bolt release arm engageable with said portion of said emergency release arm during movement of said bolt release and control member from its second position to its third position for pivoting said release arm to move said actuator arm to its first position to consequently effect movement of said dead bolt to its retracted position.

53. The invention of claim 52, wherein said dead bolt deadlock comprises:

an elongated member pivotally supported on one end for movement between a locking position adjacent said dead bolt and a bolt freeing position spaced from and not contacting said dead bolt and having first and second abutment surfaces respectively engageable with opposite sides of said radial flange when the deadlock is in its locking position for deadlocking said dead bolt in either its extended or retracted positions.

54. The invention of claim 53, wherein said deadlock includes camming surfaces engageable by said camming finger during the initial movement of said actuator arm from either of its first or second positions toward the other position for moving said deadlock outwardly to its freeing position during freeplay movement of the actuator arm in the drive slot prior to the initiation of movement of said dead bolt as the actuator arm reaches the end of the drive slot to drivingly engage same.

55. A door locking and control system including:

a door movable between open and closed positions;

a dead bolt movable between a locking position and an unlocking position with respect to said door;

selectively operable electrical dead bolt drive means for effecting positioning said dead bolt in either its locking or unlocking position;

a lock bolt movable between locking and unlocking positions with respect to said door;

a control station at a location remote from said door including:

a control member movable to a deadlock position, an operate position and a release position; and selectively operable electrical actuator means for actuating said dead bolt drive means for effecting the positioning of said dead bolt in either its locking or unlocking position;

means permitting the movement of the lock bolt to its unlocking position by actuator means at the door in response to the positioning of said control member in its operate position concurrently with the positioning of said dead bolt in its unlocking position; and mechanical means for mechanically moving said lock bolt and said dead bolt to their unlocking positions in response to the movement of said control member to its release position.

56. The invention of claim 55, additionally including means operative in response to movement of said control member to its deadlock position while said door is open for locking said lock bolt in its locking position upon the closure of said door.

57. The invention of claim 56, additionally including means preventing actuation of said selectively operable electrical dead bolt drive means for effecting movement of said dead bolt to its unlocking position when said control member is in its deadlock position.

58. The invention of claim 56, additionally including mechanical means responsive to movement of said control member to its deadlock position for mechanically moving said dead bolt to its locking position when said dead bolt is in its unlocking position upon the occurrence of such positioning of the control member.

59. The invention of claim 58, additionally including mechanical means responsive to the positioning of said control member in its deadlock position concurrently with said lock bolt being in its locking position for preventing movement of said lock bolt from its locking position.

60. The invention of claim 55, additionally including means responsive to the positioning of said door in an open position for preventing actuation of said selectively operable electrical dead bolt drive means.

61. The invention of claim 55, wherein said actuator means at the door includes a key-controlled switch.

62. The invention of claim 55, wherein said actuator means at the door includes a pusher member movable by key controlled mechanical lock means for engaging said lock bolt to move said lock bolt to its unlocking position.

* * * * *